United States Patent [19]

Watanabe

[11] Patent Number: 5,020,483

[45] Date of Patent: Jun. 4, 1991

[54] INTAKE SYSTEM FOR TWO CYCLE INTERNAL COMBUSTION ENGINE

[75] Inventor: Eifu Watanabe, Hamamatsu, Japan

[73] Assignee: Sanshin Kogyo Kabushiki Kaisha, Hamamatsu, Japan

[21] Appl. No.: 472,340

[22] Filed: Jan. 30, 1990

[30] Foreign Application Priority Data

Jan. 31, 1989 [JP] Japan ..... 1-22429

[51] Int. Cl.[5] ..... F02M 35/10

[52] U.S. Cl. ..... 123/52 MV; 123/73 A; 123/52 MB

[58] Field of Search ..... 123/52 M, 52 MV, 52 MC, 123/52 MF, 52 MB, 73 A, 73 B, 73 C, 73 V

[56] References Cited

U.S. PATENT DOCUMENTS

| | | | |
|---|---|---|---|
| 2,844,133 | 7/1958 | Thompson | 123/52 MV |
| 3,851,631 | 12/1974 | Kiekhaefer | 123/73 A |
| 4,266,514 | 5/1981 | Tyner | 123/73 A |
| 4,702,202 | 10/1987 | Hensel et al. | 123/73 A |
| 4,784,090 | 11/1988 | Sougawa | 123/52 MV |
| 4,903,649 | 2/1990 | Staerzl | 123/73 A |
| 4,920,933 | 5/1990 | Iwai et al. | 123/73 A |

FOREIGN PATENT DOCUMENTS

| | | | |
|---|---|---|---|
| 2750586 | 7/1978 | Fed. Rep. of Germany | 123/52 MV |
| 0110845 | 7/1983 | Japan | 123/73 A |

*Primary Examiner*—David A. Okonsky

*Attorney, Agent, or Firm*—Ernest A. Beutler

[57] ABSTRACT

An outboard motor having an improved, compact induction system for a V-type engine. The induction system includes angularly related intake passages that are disposed at an angle that is less than the angle between the cylinder banks. Reed valves are interposed between the intake passages and the crankcase chamber. These reed valves extend perpendicularly to extensions of the cylinder bore axes. An improved balancing arrangement is also incorporated that comprises plenum chambers that surround the pairs of intake passages and the intake passages each communicate with the respective plenum chambers through relatively small openings.

19 Claims, 4 Drawing Sheets

INTAKE SYSTEM FOR TWO CYCLE INTERNAL COMBUSTION ENGINE

BACKGROUND OF THE INVENTION

This invention relates to an intake system for a two cycle internal combustion engine and more particularly to an improved intake system for such an engine in which the cylinder banks are disposed at an angle to each other and also to an improved balancing arrangement for multiple cylinders of an engine of this type.

In two cycle crankcase compression V-type engines, it is the practice to employ an induction system that has intake passages for serving the individual crankcase chambers of the engine. These intake passages have been oriented either in a direction so that they extend parallel to each other and thus are disposed at an angle to the cylinder bores of the crankcase chambers being served or at an angle to each other which is generally an extension of the cylinder bore axis. Each type of arrangement has certain disadvantages.

For example, if the intake passages extend parallel to each other and at an angle to the cylinder bores of the crankcase chambers which they serve, then the intake charge must flow through an angle which reduces the charging efficiency of the engine. It is, of course, desirable to provide an induction system that permits good charging efficiency. However, it is also desirable to maintain the induction system as small as possible for limiting the space utilization of the engine. This is, of course, somewhat inconsistent with the necessity for providing good charging efficiency. In addition to the disadvantage of increased flow resistance, the use of intake passages that are at an angle to the axis of the cylinder bore which they serve gives rise to poor mixing of the total intake charge in the crankcase chambers. That is, the last portion of the charge inducted may be trapped in the crankcase chamber and not compressed and transferred to the cylinder bore and thus reduce the output of the engine.

Where the intake passages are aligned with the cylinder bores, the charging efficiency problems noted above are not present. However, this angular disposition of the intake passages significantly increases the volume of the engine. This is not particularly desirable, especially where the engine is utilized in conjunction with an outboard motor. Such applications are, of course, typical of two cycle crankcase compression engines.

The aforenoted problems are further compounded by the fact that it is the conventional practice to employ reed type valves in the induction passages between the intake system and the individual crankcase chambers so as to prevent reverse flow. In order to provide good charging efficiency, it is desirable to have the reed type check valves extend perpendicularly to the intake passage. When this is the case, the aforenoted problems are magnified with either type of orientation of the intake passage relative to the cylinder bore axis.

It is, therefore, a principal object of this invention to provide an improved induction system for a V-type engine which will have good charging efficiency and, at the same time, provide a compact engine arrangement.

It is a further object of the invention to provide an improved compact intake system for a crankcase compression two cycle engine having angularly disposed cylinder banks and including reed type check valves in the induction system.

The angular disposition of the reed type check valve relative to the intake passage also gives rise to an increased volume in the crankcase chambers. This can reduce the effective compression ratio of the engine. This, of course, is undesirable since it will reduce the performance of the engine.

It is, therefore, a still further object of this invention to provide an improved arrangement for an engine wherein the reed type check valves can be disposed so as to have a maximum area and without increasing the flow resistance of the engine or its overall size.

It has also been recognized that cylinder to cylinder variation and engine performance for a multiple cylinder engine can be improved if the intake passages serving the individual chambers of the engine are connected by means of balance passages. This is particularly true in connection with two cycle crankcase compression engines. It is another object of the invention to provide an improved balance passage arrangement for a multiple cylinder crankcase compression two cycle engine.

SUMMARY OF THE INVENTION

A first feature of this invention is adapted to be embodied in an induction system for a V-type crankcase compression two cycle engine having a pair of angularly disposed cylinder banks that extend from a crankcase which defines crankcase chamber sections for the individual cylinders of the cylinder banks. A pair of angularly related intake passages are provided for delivering a charge to the respective crankcase chamber sections of the respective cylinder banks. In accordance with a feature of the invention, the angle between the intake passages is less than the angle of the cylinder banks.

A further feature of this invention is adapted to be embodied in an induction system for a crankcase compression two cycle multiple cylinder internal combustion engine. In accordance with this feature of the invention, individual intake passages serve each of the crankcase sections of the engine associated with the respective cylinders. Balance passages are incorporated that interconnect these passages with an enlarged volume plenum chamber.

DETAILED DESCRIPTION OF THE PREFERRED EMBODIMENT OF THE INVENTION

Figure 1:
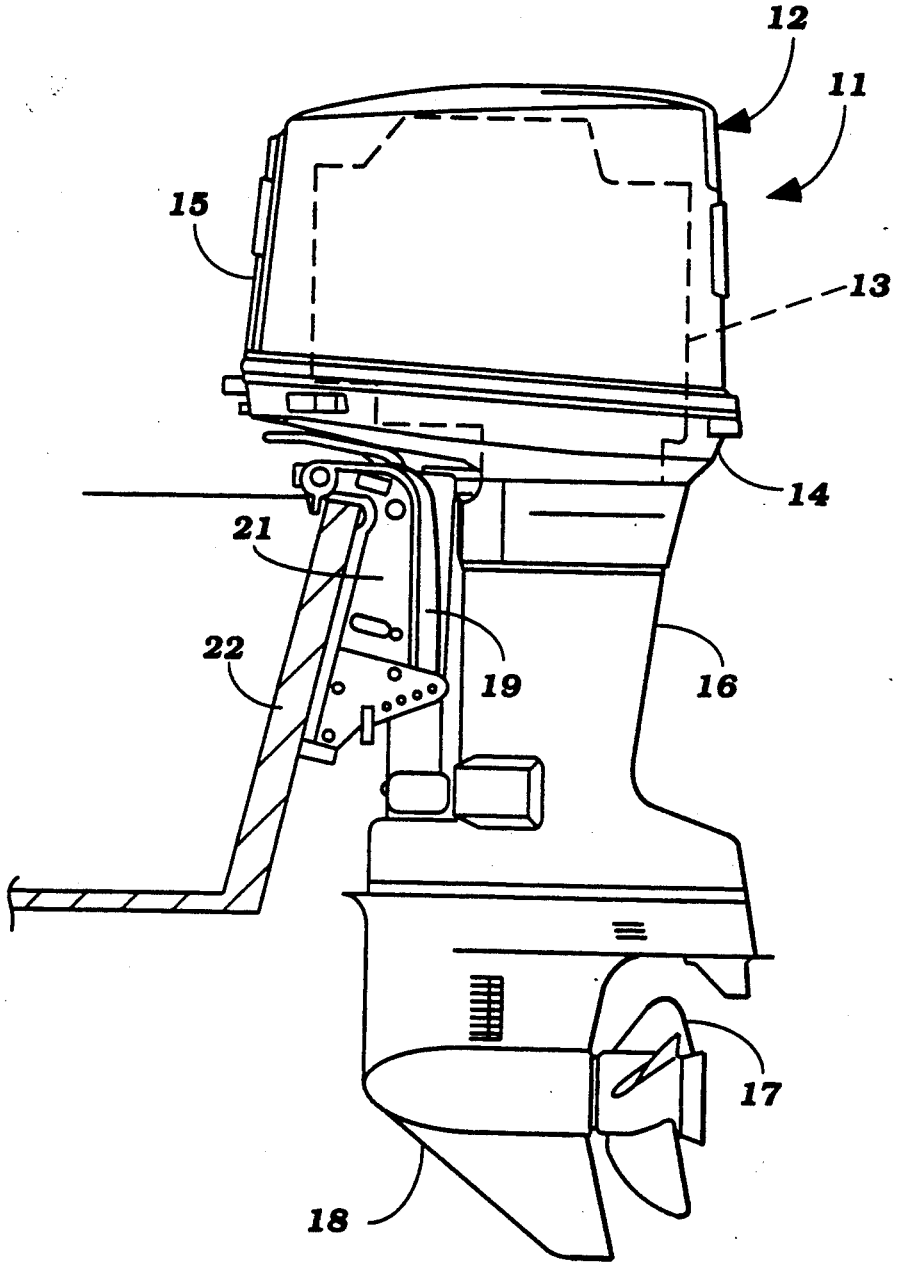
FIG. 1 is a side elevational view of an outboard motor constructed in accordance with an embodiment of invention.

Referring first to FIG. 1, an outboard motor is depicted and is indicated generally by the reference numeral 11. The invention is described in conjunction with an outboard motor because this is a typical application for V-type two cycle crankcase compression internal combustion engines. It is to be understood, however, that the invention can be utilized in conjunction with other applications for such engines.

The outboard motor 11 includes a power head assembly, indicated generally by the reference numeral 12 which includes an internal combustion engine 13, of a type to be described, and a protective cowling comprised of a tray 14 and main cover portion 15.

The engine 13 is supported so that its crankshaft (to be described) rotates about a vertically extending axis and drives a drive shaft that is contained within a drive shaft housing 16 that depends from the power head 12. This drive shaft drives a propeller 17 by means of a forward, neutral, reverse transmission of a known type which is incorporated within a lower unit 18 positioned beneath and affixed to the drive shaft housing 16.

A steering shaft (not shown) is affixed to the drive shaft housing 16 and is journaled for steering movement within a swivel bracket 19 for steering of the outboard motor 11. The swivel bracket 19 is, in turn, pivotally connected to a clamping bracket 21 for tilt and trim movement in a known manner. The clamping bracket 21 is, in turn, adapted to be affixed to a transom 22 of an associated watercraft in a known manner. The construction of the outboard motor 11 as thus far described may be considered to be conventional. Also, as noted, the invention relates to the engine 13 and specifically its induction system. For that reason, details of the construction of the outboard motor apart from the engine are believed to be unnecessary to understand the invention.

Figure 2:
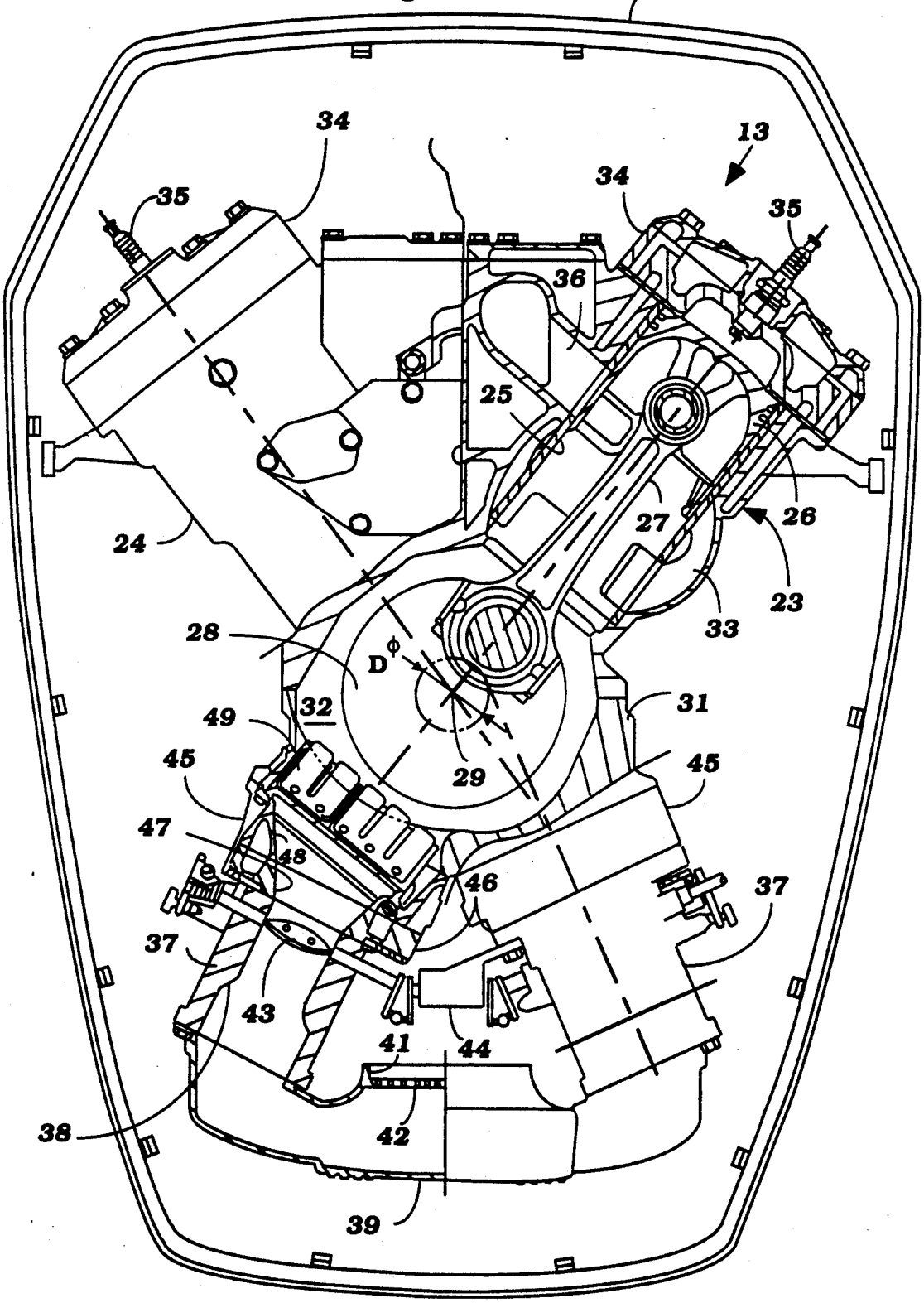
FIG. 2 is an enlarged top plan view of the power head with the cover of the protective cowling removed and with portions of the engine broken away.
Figure 3:
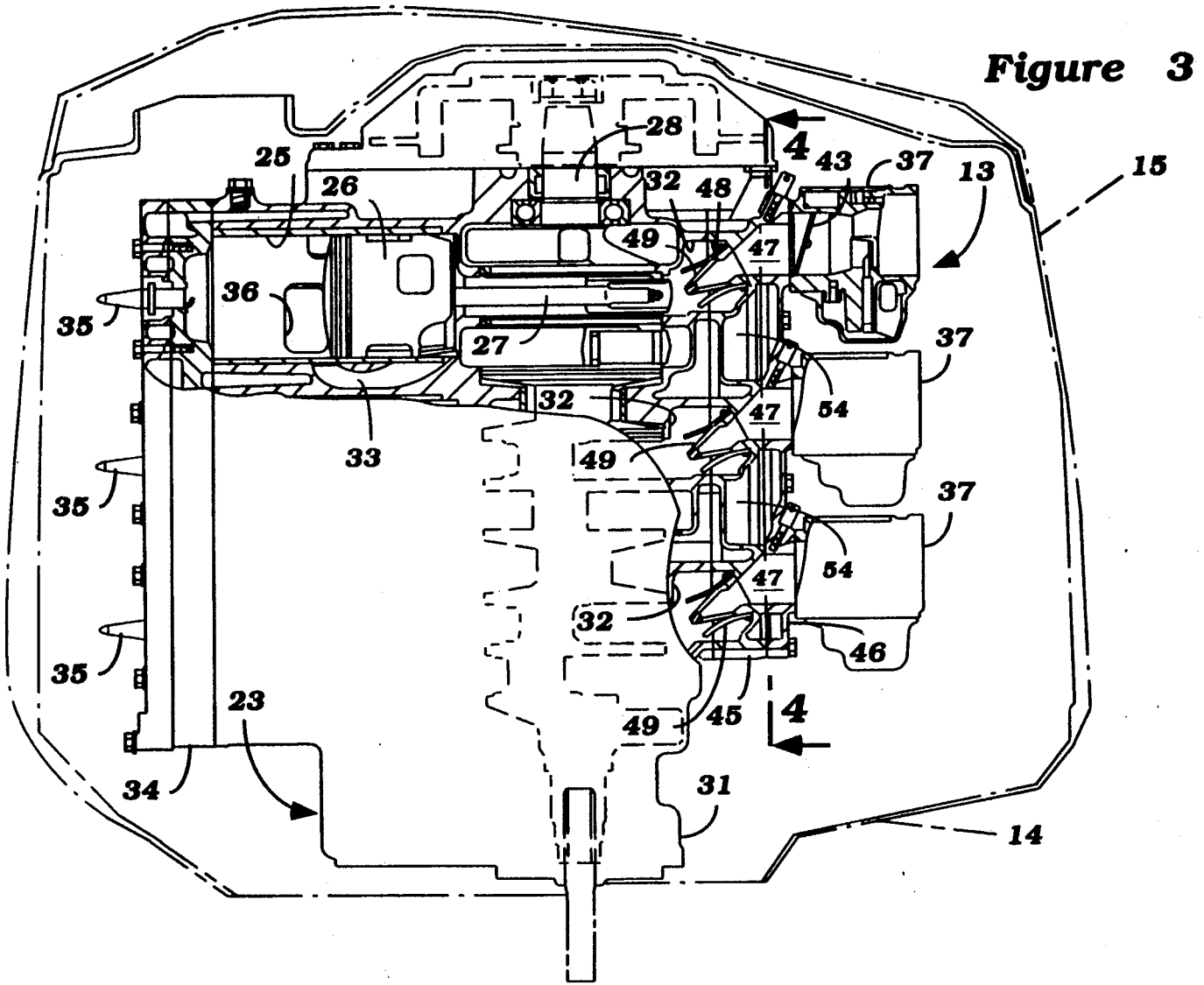
FIG. 3 is an enlarged side elevational view of the power head with the protective cowling shown in phantom and portions of the engine broken away.
Figure 4:
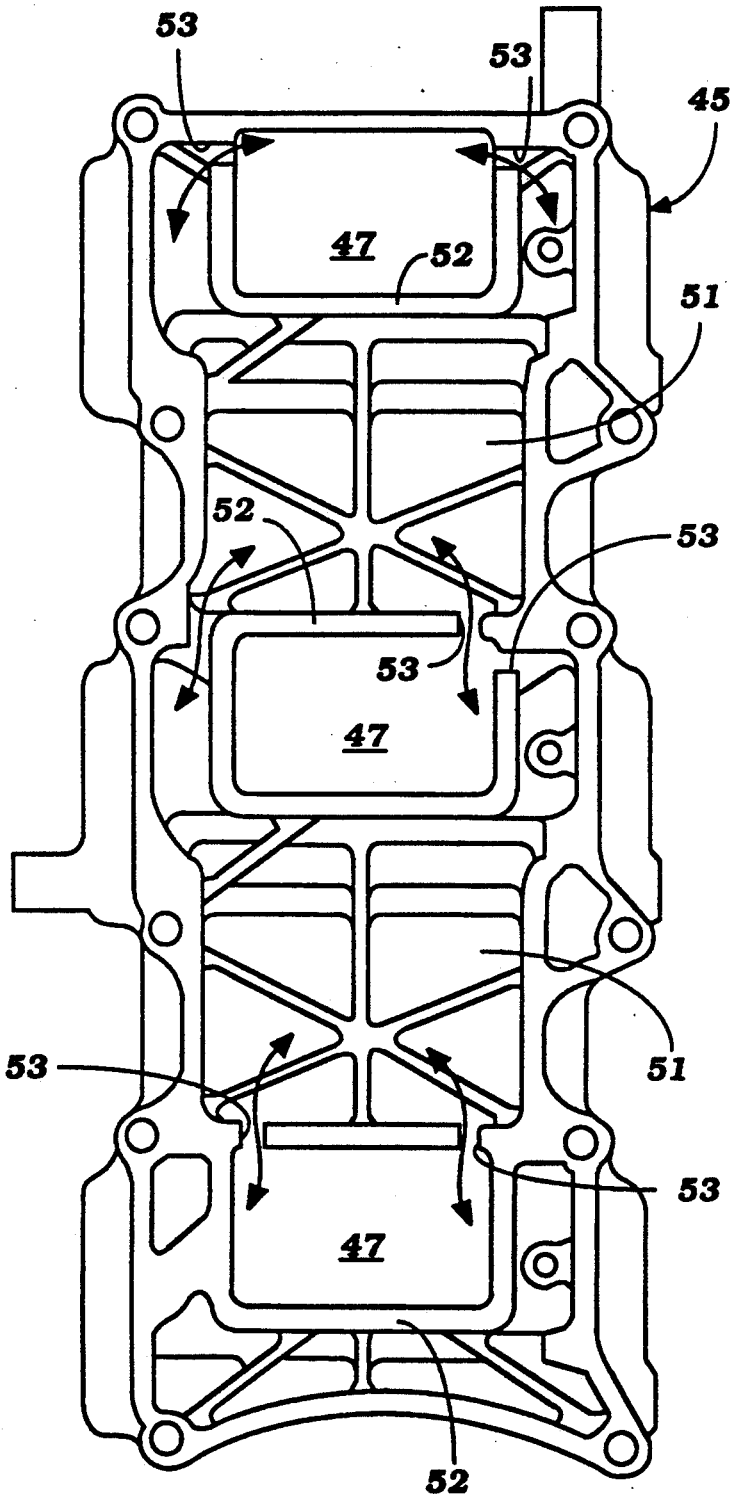
FIG. 4 is a further enlarged cross sectional view taken along the line 4—4 of FIG. 1.

Referring now in detail to the remaining figures and initially to FIGS. 2 and 3, the engine 13 is depicted as being of the V-6 type and thus has a cylinder block 23 which is provided with angularly disposed cylinder banks 24, each of which is provided with three cylinder bores 25. Although the invention is described in conjunction with a V-6 type of engine, it is to be understood that the invention may be utilized with engines having other cylinder numbers. In fact, certain facets of the engine can be used with multiple cylinder in line types of engines.

Pistons 26 are slidably supported in each of the cylinder bores 25 and are connected by means of connecting rods 27 to a crankshaft 28 that rotates about an axis 29. The crankshaft 28 is journaled for rotation in a crankcase assembly consisting of a crankcase body 31 and the cylinder block 23. The individual crankcase chambers 32 associated with each of the cylinder bores 25 are sealed relative to each other in a known manner.

A fuel/air charge is delivered to these crankcase chambers 32 through an induction system to be described. This charge is then compressed and is transferred through scavenge or intake passages 33 from the crankcase chambers 32 to the combustion chambers formed by the pistons 28, cylinder bores 25 and cylinder heads 34 which are affixed to each of the cylinder banks 24 in a known manner. This charge is then fired in the combustion chambers by means of spark plugs 35. The expanding gases drive the pistons 26 as is well known and then are discharged through exhaust ports 36 formed in the cylinder banks 24 in the V of the engine.

The induction system for the engine includes two pairs of three vertically disposed single barrel carburetors 37, one for each crankcase chamber 32 associated with each cylinder bank 24. The carburetors 37 may be of any known type and are provided with intake passages 38 which have flow axes that lie in common vertical planes. These planes are disposed so that they extend tangentially to a circle having the diameter D drawn around the crankshaft axis 29 but having a smaller diameter than the stroke of the engine, as clearly shown in FIG. 2. As a result, the angular disposition between the intake passage axes or these planes of the respective cylinder banks is disposed at a lesser angle than the angle between the cylinder blocks 24. This provides a very compact assembly.

The carburetors 37 draw an intake charge through an intake device and silencer 39 which has inlet openings 41 across which a screen is placed 42 for preventing the induction of foreign particles. The intake openings 41 face the valley formed between the carburetors 37. The carburetors 37 each have throttle valves 43 for controlling the flow therethrough and which throttle valves 43 are operated by a common linkage system 44 provided in the area between the carburetors 37.

There are provided pairs of reed valve blocks and manifolds 45 and spacer plates 46 that are interposed between the carburetors 37 and the crankcase 31. The plates 46 are provided with passages 47 that generally expand the flow area and which mate with corresponding passages 48 formed in the valve blocks 45. Reed valve assemblies having a generally V shaped configuration 49 extend across these passages 48 at an angle to the intake passages 38 of the carburetor and generally in perpendicular relationship to an extension of the axes of the cylinder bores 25 of the cylinder banks 24 which they serve. Therefore, the reed valves 49 extend generally in a tangential direction to the crankcase chambers 32 and there will be good induction efficiency. Also, a relatively large area for the reed valves 49 is possible due to this orientation. However, the difference in angle between the induction passages 38 of the carburetors 37 and the manifold valve block passages 48 is relatively small. The increasing flow area will insure that the induction efficiency will be high and there will be low or no losses as a result of flow restrictions and flow direction changes.

It will be noted that the spacer plates 46 and valve block manifolds 45 cooperate with each other to define a large plenum chamber volume 51 that extends around the walls 52 that define the respective passages 47. There are provided a plurality of balance openings 53 of relatively small cross sectional area that communicate with the plenum volume 51. As a result, the balance passages 53 communicate the intake passages 47 with each other so as to provide balancing. However, the interconnection with the enlarged volume plenum chamber 51 has been found to significantly increase the balancing effect of the system.

It should be readily apparent from the foregoing description that a highly effective compact induction system has been provided for a V-type two cycle crankcase compression engine and which provides low flow resistance and good charging efficiency. In addition, the balance arrangement described, which can also be utilized with in line type engines, provides good cylinder to cylinder balancing.

It is to be understood that the foregoing description is that of a preferred embodiment of the invention and that various changes and modifications may be made without departing from the spirit and scope of the invention, as defined by the appended claims.

I claim:

1. An induction system for a V-type crankcase compression two cycle internal combustion engine having a pair of angularly disposed cylinder banks extending from a crankcase defining compression crankcase chamber sections for the individual cylinders of the respective cylinder banks, and a pair of angularly related intake passages having respective longitudinal central axes for delivering a charge to the crankcase chamber sections of the respective cylinder banks, the angle between said central axes of said intake passages being less than the angle between the cylinder banks.

2. An induction system for a V-type crankcase compression two cycle internal combustion engine as set forth in claim 1 wherein the intake passages have center lines lying on planes that extend tangential to a circle having its center on the axis of rotation of the engine crankshaft.

3. An induction system for a V-type crankcase compression two cycle internal combustion engine as set forth in claim 2 wherein the circle has a diameter that is smaller than the stroke of the engine.

4. An induction system for a V-type crankcase compression two cycle internal combustion engine as set forth in claim 1 further including reed valves disposed between the intake passages and the crankcase chamber sections for preventing reverse flow from the crankcase chamber sections into the intake passages.

5. An induction system for a V-type crankcase compression two cycle internal combustion engine as set forth in claim 4 wherein the reed valves lie at an angle to the axis of the intake passages.

6. An induction system for a V-type crankcase compression two cycle internal combustion engine as set forth in claim 5 wherein the reed valves extend perpendicularly to an extension of the axis of the cylinder bores of the cylinder banks.

7. An induction system for a V-type crankcase compression two cycle internal combustion engine as set forth in claim 6 wherein the intake passages have center lines lying on planes that extend tangential to a circle having its center on the axis of rotation of the engine crankshaft.

8. An induction system for a V-type crankcase compression two cycle internal combustion engine as set forth in claim 7 wherein the circle has a diameter that is smaller than the stroke of the engine.

9. An induction system for a V-type crankcase compression two cycle internal combustion engine as set forth in claim 1 wherein there are a plurality of cylinders in each bank with the cylinders of the banks being aligned with each other and wherein there is provided an intake passage for each cylinder.

10. An induction system for a V-type crankcase compression two cycle internal combustion engine as set forth in claim 9 further including balance passage means interconnecting the intake passages of the respective pairs.

11. An induction system for a V-type crankcase compression two cycle internal combustion engine as set forth in claim 10 wherein the balance passage means comprises a plurality of restricted openings extending from the intake passages to a common enlarged plenum chamber.

12. An induction system for a V-type crankcase compression two cycle internal combustion engine as set forth in claim 11 further including reed valves disposed between the intake passages and the crankcase chamber sections for preventing reverse flow from the crankcase chamber sections into the intake passages.

13. An induction system for a V-type crankcase compression two cycle internal combustion engine as set forth in claim 12 wherein the reed valves lie at an angle to the axis of the intake passages.

14. An induction system for a V-type crankcase compression two cycle internal combustion engine as set forth in claim 13 wherein the reed valves extend perpendicularly to an extension of the axis of the cylinder bores of the cylinder banks.

15. An induction system for a V-type crankcase compression two cycle internal combustion engine as set forth in claim 11 wherein the intake passages have center lines lying on planes that extend tangential to a circle having its center on the axis of rotation of the engine crankshaft.

16. An induction system for a V-type crankcase compression two cycle internal combustion engine as set forth in claim 15 wherein the circle has a diameter that is smaller than the stroke of the engine.

17. An induction system for a multiple cylinder internal combustion engine comprising a plurality of intake passages each having an inlet end in which a respective throttle valve is positioned and an outlet end serving a respective chamber of the engine, a plenum chamber, and a plurality of relatively small cross sectional area passages interconnecting each of said intake passages between said throttle valve and said outlet end with said plenum chamber for balancing the cylinder to cylinder induction.

18. An induction system for a multiple cylinder internal combustion engine as set forth in claim 17 wherein the engine is a crankcase compression two cycle internal combustion engine and the intake passages serve individual crankcase chambers.

19. An induction system for a multiple cylinder internal combustion engine as set forth in claim 18 wherein the plenum chamber is formed by a spacer assembly interconnecting a plurality of charge formers with the crankcase chambers.

* * * * *